US006961967B1

(12) United States Patent
Brown

(10) Patent No.: US 6,961,967 B1
(45) Date of Patent: Nov. 8, 2005

(54) PERSONAL LIFT AID

(76) Inventor: Donald A. Brown, 3656 Durham Rd., Norton, OH (US) 44203

( * ) Notice: Subject to any disclaimer, the term of this patent is extended or adjusted under 35 U.S.C. 154(b) by 0 days.

(21) Appl. No.: 10/925,197

(22) Filed: Aug. 24, 2004

Related U.S. Application Data

(60) Division of application No. 09/931,711, filed on Aug. 16, 2001, now abandoned, which is a continuation-in-part of application No. 09/696,372, filed on Oct. 25, 2000, now Pat. No. 6,276,007.

(60) Provisional application No. 60/162,857, filed on Nov. 1, 1999.

(51) Int. Cl.[7] ..... A61G 7/10
(52) U.S. Cl. ..... 5/81.1 R; 5/1; 5/662; 5/925; 135/84
(58) Field of Search ..... 5/81.1 R, 662, 5/925, 420, 1; 135/84, 72; 128/845

(56) References Cited

U.S. PATENT DOCUMENTS 2,757,388 A * 8/1956 Chisholm ..... 5/507.1
4,135,536 A * 1/1979 Willis ..... 135/84
4,493,334 A * 1/1985 Semanchik et al. ..... 135/75
4,501,957 A * 2/1985 Perlman et al. ..... 235/379
4,899,771 A * 2/1990 Wilkinson ..... 135/77
5,307,828 A * 5/1994 Gardner et al. ..... 135/82
5,586,352 A * 12/1996 O'Brien et al. ..... 5/662
6,044,507 A * 4/2000 Smith ..... 5/662
6,138,699 A * 10/2000 Su ..... 135/82
6,615,432 B1 * 9/2003 Blaylock ..... 5/662

FOREIGN PATENT DOCUMENTS

GB 874724 * 8/1961

* cited by examiner

*Primary Examiner*—Alexander Grosz
(74) *Attorney, Agent, or Firm*—Brouse McDowell; Daniel A. Thomson

(57) ABSTRACT

A personal lift aid for lifting and lowering ambulatory patients and other individuals by unassisted and assisted means. The invention device comprises of a stanchion assembly having a palm grip to an upper end thereof; three adjustable hand grips located below said palm grip; and a (step-on) anchor pad located at the lower end of the device to anchor the personal lift aid to the floor or ground during lifting and lowering of individuals.

Methods of moving a person with the aid of the personal lift aid include methods of a caregiver assisting the person; methods of unaided moving by the person, and methods of traversing stairs.

9 Claims, 9 Drawing Sheets

$$(\text{Ideal})\ \text{Mechanical Advantage} = \frac{\text{Effort Distance (E.D.)}}{\text{Resistance Dist. (R.D.)}}$$

$$(\text{Real})\ \text{Mechanical Advantage} = \frac{\text{Resistence}}{\text{Effort}}$$

$$\text{E.D.} = \frac{R\ \text{(patient)}}{E\ \text{(nurse)}}$$

$$E = R\,\frac{\text{R.D.}}{\text{E.D.}}$$

PERSONAL LIFT AID

CROSS-REFERENCE TO RELATED APPLICATIONS

This application is a divisional application of Ser. No. 09/931,711, filed Aug. 16, 2001 now abandoned, which is a continuation-in-part of Ser. No. 09/696,372, filed on Oct. 25, 2000, which is now U.S. Pat. No. 6,276,007, which claims the benefit of Provisional application Ser. No. 60/162,857, filed Nov. 1, 1999.

STATEMENT REGARDING FEDERALLY SPONSORED RESEARCH OR DEVELOPMENT

Not Applicable.

BACKGROUND

1. Field of the Invention

The present invention relates to patient lift devices and more particularly pertains to portable patient lifts aiding in the lifting and lowering of patients and others that may have specific needs.

2. Background of the Invention

The use of patient lifts, and more specifically, portable patient lifts heretofore devised and utilized are known to comprise of complicated structural configurations, not withstanding the myriad of designs encompassed by the crowded field that have been developed for the fulfillment of countless objectives and requirements. Known prior patient lifts include U.S. Pat. No. 5,189,741; U.S. Pat. No. 5,327,592; U.S. Pat. No. 5,802,633; U.S. Pat. No. 5,090,072; U.S. Pat. No. 5,093,944.

1. Various types of complex mechanical and electromechanical patient lift devices have been around for years.

a. I have discovered that caregivers and other individuals are reluctant to use them because they are large, heavy, bulky, complicated, and time consuming to setup and use.

b. Said devices have been found to be costly, a storage problem, and require the assistance of other(s) to operate.

2. The devices are also limited in that they only pertain to the non-ambulatory, invalid, or bed-ridden patient.

a. Furthermore, the devices have a limited use of only lifting and lowering said patients.

b. The devices have short-range transport capability, and, consequently, are substantially restricted to indoor use. As a result, individuals cannot take them to work, to a restaurant, to attend a sporting event, or other daily outside activities.

3. Additionally, the devices are not designed for an individual to use as a rehabilitation aid that may help them regain a mobile lifestyle.

4. While these devices fulfill their respective particular objectives and requirements, the aforementioned do not disclose a personal lift aid that may be used for the two different modes of operation that are as follows: Unassisted (where the patient and/or individual can use it by themselves) or Assisted (with the help of a caregiver or spouse).

5. Not found was a lift device specifically designed to lift and lower ambulatory patients and other individuals.

6. Also not disclosed is an unassisted portable aid to descend and ascend stairs, which is manually operated and not powered by electric or hydraulics.

7. Furthermore, I was not able to find a device without wheels whose base support was anchored to the ground or floor by means of stepping on it. The devices that were discovered required fasteners such as bolts or screws to attach the devices to the ceiling or floor, thus marring said surfaces.

8. Finally, not found was a portable lift and lowering device able to be purchased for a price that is affordable to most people so that they can use it while they are in the hospital or at home.

SUMMARY OF THE INVENTION

The novel personal lift aid comprises of an elongated member, such as a stanchion (reinforced pole), palm-grip, three adjustable hand grips, and a (step-on) anchor pad with a molded pivotable neck. Said device is intended for ambulatory individuals who need help with their personal lifting and lowering. The present invention is simple and yet efficient in its operation while providing multiple services to a wide spectrum of individuals who have various healthcare needs.

In recent years, the insurance industry as well as other healthcare industries have implemented major changes regarding the number of patient recovery days spent in the hospital. In most cases, this has been shortened from weeks to days. Because of these recent changes, rehabilitation of individuals has moved to nursing homes, rehab centers, and home healthcare. This personal lift aid comes at the right time to provide an invaluable aid to ambulatory individuals who need help with their rehabilitation and in accomplishing everyday activities.

The statement, "necessity is the mother of invention," certainly applies to this invention. Not long ago, I had gallbladder surgery at one of the nation's top-rated hospitals in Ohio. Fortunately, I was able to have the less invasive type surgery called laparoscopic; but, after surgery, I found myself struggling to sit up, lay back, stand, and walk. I was well aware of the pain and careful not to put undue stress on the affected traumatized area. The hospital had invested millions of dollars in operating room equipment, but had no lift aid available for ambulatory patients, post surgery, such as myself. What is needed is a personal lift aid device for a continuum of support from the hospital to the home.

Returning home, I had a hard time getting in and out of the car. The next day my wife had to return to work and that left me home alone to care for myself. I seemed to struggle more at home when I tried to sit up and stand, and felt that I had torn my sutures. I knew there had to be a better way of moving about.

I experimented with a hollow pole about four foot in length, as I tried to stand, holding it vertically in front of me and using the lower end as a pivot point on the floor. However, the bottom kept slipping and moving as I attempted to stand. I thought about putting a wide base on the bottom of the pole and using a nail or screw to anchor it to the floor to prevent it from slipping and moving back, but that wasn't a viable option. It took awhile, but I finally came up with the idea of a flat anchor pad made of semi-hard material that I could step on with one or both feet to anchor it to the floor. I'm happy to report that it worked, and the anchor pad remained securely in place. I also encountered a problem with the pole in that it would bend while in use, and I realized that I needed to reinforce it for strength and durability.

Soon, thereafter, I began to refine the invention and the techniques to use it. I discovered that it could not only be used in the foregoing unassisted mode of operation but also in an assisted mode of operation. In the assisted mode of operation my wife could easily lift and lower me whenever I needed the help. I believe that the personal lift aid will help lead the way in helping other individuals, as it has helped me, toward a more comfortable recovery.

In accordance with the present invention, the personal lift aid is human powered, and is used with leverage techniques to lift and lower ambulatory individuals to standing, sitting, or supine positions. It can also be used as an aid to support the individual while ascending and descending stairs.

As mentioned, the personal lift aid is novel in that it can be used in two different modes of operation, unassisted and assisted. The ambulatory individual's degree of participation in using the personal lift aid depends on the condition of that particular individual. The individual's condition will dictate which mode of operation is best suited for them. Therefore, while the patient is in the hospital, the patient's doctor or nurse will determine the appropriate mode of operation for the individual to use.

In the unassisted mode, the individual uses the device by themselves using all of his or her body muscles, particularly their arms and legs, to lift, lower, sit-up, and lay back. This mode of operation actually promotes a more speedy and safe rehabilitation toward regaining one's full mobility.

In the assisted mode, the individual uses the device with the help of a caregiver who helps with the lifting or lowering. In this mode the individual only uses their legs to participate while limiting the use of their arms to only holding onto the hand grips, not using them to pull themselves up. The rehabilitation time is usually slower when being assisted by a caregiver, but once the individual starts to regain their strength they can move up to using the unassisted mode of operation.

No one, to our knowledge, has ever thought of a personal lift aid to assist temporarily incapacitated patients or other individuals who are ambulatory. Most individuals who enter hospitals are capable of walking, but become temporarily weak because of surgery or other causes, and need help with their mobility and rehabilitation efforts, both while in the hospital and when they return home. Other individuals such as the elderly and overweight needing help with their lifestyles will also benefit from this new invention since it can be used almost anywhere indoors or outdoors. It can be taken to work, on a trip, to a sporting event, a concert, etc.

Objects and Advantages

Accordingly, besides the objects and advantages of the unique personal lift aid device described in the above patent, several objects and advantages of the present invention are as follows:

a. This new invention is used to provide two modes of operation for the purpose of lifting and lowering ambulatory individuals:

Unassisted—independent use, utilizing the reinforced stanchion, handgrips and step-on anchor pad.

Assisted—with the help of a caregiver utilizing the reinforced stanchion, palm grip and step-on anchor pad.

b. Said device's novel (step-on) anchor pad is capable of being anchored to the ground or floor by simply placing one or both feet on the anchor pad while it is being used to lift and lower individuals.

c. The device's pivotable neck and anchor pad are a one-piece molded unit in which the neck rotates at various degrees enabling the bottom of the anchor pad to always lay flat on the ground for optimum surface contact.

d. The stanchion is made of extruded aluminum with a Y shape internal reinforcement for added lifting strength.

e. A palm grip attached at the upper end of said stanchion is mainly used by a caregiver in the assisted mode to lift and lower individuals.

f. Three hand grips employing a tack-and-hold grip are attached to said stanchion below the palm grip. The upper two hand grips are primarily used by the individual as an aid for lifting and lowering when in a bed, chair, toilet, car, etc. The lower hand grip is used in combination with said palm grip to sit up or lay back to a supine position in bed.

g. Simplicity of design and ease of use with no setup needed results in a people friendly aid.

h. The invention, low in cost to manufacture, is very affordable to purchase compared to other more complex and costly devices that are on the market.

i. Lightweight and durable construction; can be lifted with one hand.

j. Compact design, can easily fit in front or back seat of a car, beside you with minimal storage space required.

k. By utilizing the height of our device and the adjustable tack-and-hold hand grips, individuals are able to erectly descend and ascend stairs safely.

l. Helps prevent workplace back injuries and musculoskeletal disorders due to lifting and lowering individuals.

During the invention stage of said device, the inventor was recovering from gallbladder surgery, as previously stated, and was able to monitor and use his pain thresholds to determine and develop prototypes for increasing his mobility. After many refinements he settled on a final design for the personal lift aid as shown in FIG. 1 of the drawings. He worked by himself in his workshop and constructed thirty of the personal lift aid devices. Over half of the devices are in use by individuals who have learned about it by word of mouth. All of these individuals have expressed total satisfaction with the personal lift aid's use and have returned none.

An individual who had undergone a hernia operation asked if he could use the personal lift aid post surgery. The individual used the device unassisted, and stated that it never left his side during his entire rehabilitation, indoors or outdoors. He further said that he tried once getting up without it and experienced a great deal of pain, but when using the personal lift aid he hardly felt any pain. He felt so secure with it that he wasn't afraid to go anywhere as long as he had his personal lift aid at his side.

A 90-year old woman that recently underwent angioplasty also used the device successfully. While she was in the hospital, her physician, nurses, and other individuals asked about the device, and said that they had never seen anything like it before. She explained to them how it worked, and how well she liked it. Later, she stated that the personal lift aid should be at every bedside for both nurses and patients to use.

A husband and wife in their 70s also needed help and used the personal lift aid. The wife was able to lift her husband, who weighed over 350 lbs., out of a chair with the device, even though a few years prior she had undergone a hip replacement. She is a retired career registered nurse who said that the personal lift aid was easy to use when she lifted her husband, and that she was grateful that it did not create any back or hip pain for her whatsoever.

Although the primary function of the personal lift aid is to lift and lower individuals, the above patients and other individuals have mentioned that they have used it successfully in a number of different situations; such as, to support themselves when they felt weak as a result of having the flu, to help them up from a kneeling position while gardening in a flower bed, getting in and out of a truck, walking up an escalator, using it to help them exercise, and in other everyday activities. Some said that it helped to stretch their back muscles and relieve their lower back pain because they were able to use it to stand erectly.

Hospitals today want patients to get out of bed as soon as possible to begin rehabilitation, thus reducing the likelihood of complications occurring as a result of being bed-ridden and fear of moving about. It is also important for the patients to start using the affected muscles, that were traumatized as a result of surgery, and to move about as soon as possible so that blood circulation returns to normal. The personal lift aid helps the individual out of a bed or chair and also supports them once they are up and about, thereby aiding in their rehabilitation. Hospitals are a safe place, but can even be safer for individuals if they are given the opportunity to use the personal lift aid.

OSHA estimates that each year 1.8 million U.S. workers experience work-related musculoskeletal disorders (MSDs) and that they account for 34 percent of all lost workday injuries and illnesses. The Occupational Safety & Health Administration (OSHA) as well as the Bureau of Workers' Compensation (BWC) has outlined their keys to success in implementing their proposed ergonomic program standard to fit the worker and work. The keys to success for the proposal are simple: reduce repeated motions, avoid prolonged bending, and rely on equipment—not backs—for heavy and repetitive lifting and lowering. "Work related MSDs, such as back injuries are the most prevalent, most expensive, and most preventable workplace injuries in the country," says U.S. Secretary of Labor Alexis M Herman.

Healthcare workers involved in direct patient handling activities, especially those in nursing homes and skilled care facilities, continue to incur back injuries at a significant rate. Patient handling tasks pose ergonomic challenges that so far have been unanswered. The statistics for occupational injuries for nursing home workers, according to the U.S. Department of Labor, Bureau of Labor Statistics, 1994, are alarmingly high. A major portion of these occupational injuries are back related, and occur while lifting and lowering individuals. By using the personal lift aid, most back injuries can be significantly reduced and/or eliminated for nurses and caregivers in skilled care and nursing home facilities who repeatedly lift and lower individuals on a daily basis.

These and other objects of the present invention are achieved in the preferred embodiments disclosed below by providing a personal lift aid device. In this respect, before explaining the preferred embodiments of the invention in detail, it is to be understood that the invention is not limited in its application to the details of the construction and to the arrangements of the components set forth in the following description or illustrated in the drawings. The invention is capable of other embodiments of being practiced and carried out in various ways. Also, it is to be understood that the phraseology and terminology employed herein are for the purpose of description and should not be regarded as limiting.

These, together with still other objects of the invention along with the various features of novelty which characterize the invention are pointed out with particularity in the claims and forming a part of this disclosure. For better understanding of the invention its operating advantages and the specific objects attained by its uses, reference should be made to the accompanying drawings and descriptive matter in which there are illustrated preferred embodiments of the invention.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT

Figure 1:
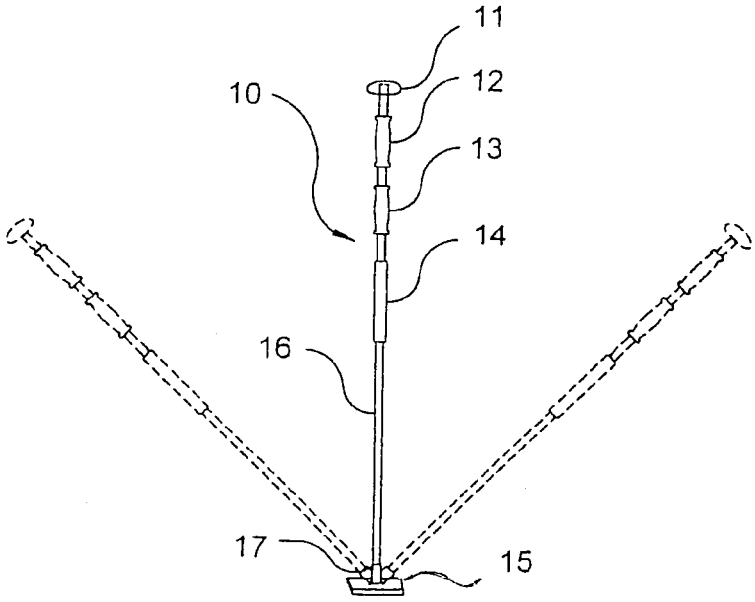
FIG. 1 shows various aspects of a personal lift aid device comprised of a reinforced stanchion 16 about four feet long. A palm grip 11 centrally located at the upper end of the stanchion 16. Three adjustable hand grips 12, 13, 14, placed thereafter on the stanchion 16. A (step on) anchor pad 15 with a molded pivotable neck 17, both being one unit, located at the lower end of the reinforced section stanchion 16.

With reference to the drawings and in particular to FIG. 1 thereof, the novel new personal lift aid embodying the principles and concepts of the present invention and generally designated by the reference number 10 will be described.

Figure 2:
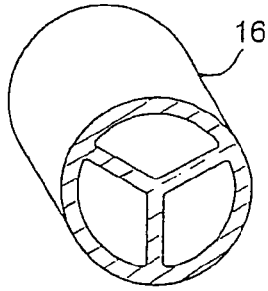
FIG. 2 shows an exploded cross-sectional view of the stanchion 16.

More specifically, said device comprises of an elongated member 16, such as a stanchion 16, made of extruded, durable, one piece aluminum, about four feet in length with about a three-quarter inch diameter and reinforced internally with a Y shape FIG. 2 for added strength and durability. Said stanchion 16 is a uniform cylinder pole in its entirety from the upper end to the lower end. The stanchion 16 acts as a lever to enable lifting and lowering of individuals.

In the preferred embodiment, the stanchion 16 is about four feet in length. However, the stanchion 16 can be any length chosen within sound engineering judgment. For example, the length of the stanchion 16 can be reduced so that a child can easily use the personal lift aid. Further, the stanchion 16 can be adjustable, so that the length of the stanchion 16 can be adjusted to the specific needs of the individual user.

Figure 3:
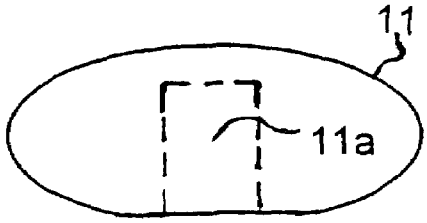
FIG. 3 shows a front view of the palm grip 11 with its molded socket 11*a*.

A palm grip 11 made of a semi-hard material with a durometer reading of between 75A–95A hardness and secured to the stanchion 16 at its upper end. The palm grip 11 is approximately three and one-half inches wide by one and one-half inches high. This upper end of the stanchion 16 is inserted into the socket opening FIG. 3, 11*a* of said palm grip 11 with a tight frictional fit thereof for permitting manual maneuverability by a caregiver. The palm grip 11 is used with two hands, one on top of the other, for exerting an effort to pull said stanchion 16. It is to be understood that the caregiver could use only one hand, as well as using bent arms. Said grip 11, while being specially designed to fit into the palm of a person's hand, utilizes ergonomically correct techniques by helping the wrist stay straight during the lifting procedure.

In the preferred embodiment, the palm grip 11 is secured to the stanchion 16 via friction. However, any securing means chosen with sound engineering judgment, such as a thread type attachment, screws, nuts and bolts, adhesives, etc., may be used to secure the palm grip 11 to the stanchion 16. Further, the stanchion 16 and the palm grip 11 can be made of a single piece of material.

Three hand grips 12, 13, and 14, are manually manipulated by the individual during use thereof to achieve certain methods of operation, further described in the operation section. Hand grips 12 and 13 are about five inches long by about one and one-half inches in diameter. Hand grip 14 is about eight inches long and also about one and one-half inches in diameter. The three hand grips 12, 13, and 14, all have a hollow, internal, uniform cavity in their center running lengthwise, with about a three-quarter inch diameter. Said hand grips 12, 13, and 14, are made of a soft touch, closed cell material that is easy to clean, durable and non-absorbent, and have an outer surface that is grippable. The hand grips 12, 13, and 14, inside cavity surface is capable, when grasped firmly, of tacking-and-holding said stanchion 16 to prevent slipping. They are also capable of sliding up and down to adjust to an individual's height. To move the hand grips 12, 13, or 14, down simply place two fingers on the top of said grip 12, 13, or 14 and push down. To move said grips up 12, 13, or 14, place two fingers on the bottom of the grips 12, 13, or 14 and push up. In certain situations, one may need to lower hand grips 12 and 13 after moving from a high bed height to a lower toilet height for their personal comfort level. Hand grips 12 and 13 helps one to increase their range of motion post surgery, by gradually raising themselves from a lower position. By grasping said hand grips 12 and 13, the individual pulls down and back towards themselves on the stanchion 16 creating a resistance point.

In the preferred embodiment, the stanchion 16 includes three hand grips 12, 13, and 14. However, the three hand grips 12, 13, and 14 are only a preferred embodiment of the invention and should not be construed to limit the invention in any way. The stanchion 16 may have no hand grips, it may have more than three hand grips, or it may have less than three hand grips (not shown).

A ground engaging (step-on) anchor pad 15 and its molded pivotable neck 17 are a one piece unit made of semi-hard material with a durometer reading of between 50A–75A hardness and secured to the lower end of the stanchion 16. The shape of said anchor pad 15 is a flat rectangular design about two and one-half inches wide by about five inches in length with four corners and a perimeter edge FIG. 5, 15*b* that has a flat surface perpendicular to the floor.

Figure 4:
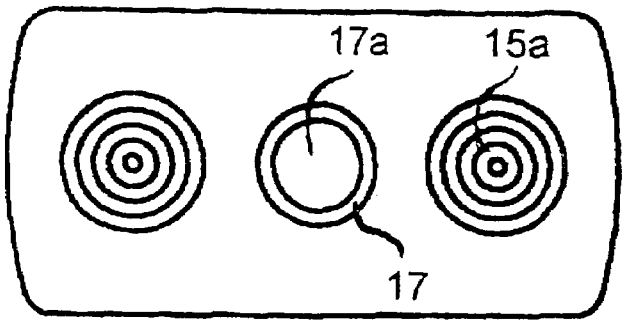
FIG. 4 shows the top view of the anchor pad 15 with raised top rings 15*a* for stepping on, and a pivotable neck 17 and socket 17*a*.

The top of said anchor pad FIG. 4 is flat by design thus enabling an individual to stand firmly and substantially with the ball of one or both feet on the molded raised top rings 15*a*. The bottom of said anchor pad FIG. 7 is also flat by design enabling it to have maximum surface contact for optimum anchoring to the ground or floor when being stepped on, thus not allowing it to roll or move.

Figure 7:
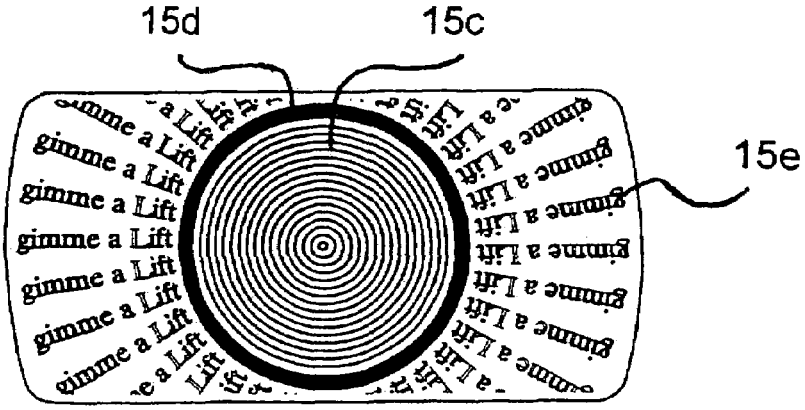
FIG. 7 is a bottom view of said anchor pad 15 with circular rings 15*c*, inverted ring 15*d*, and raised letters 15*e*.

Preferably, the bottom of said anchor pad FIG. 7 has raised bottom rings 15*c* located in the center for gripping hard surfaced ground and floors by applying downward pressure on the stanchion 16 with the use of any combination of the hand grips 12, 13, or 14. Said rings FIG. 7, 15*c* have a circular shape to enable said stanchion 16 to be used at various angles, thus preventing movement and/or slipping of the stanchion's 16 base. On the perimeter of said circular rings 15*c* is an enlarged, deep grooved and inverted, wide ring 15*d*, about ⅛ to ¼-inch wide with a depth of ⅛-inch, specifically designed for gripping carpet and other like objects while using said stanchion 16. The bottom of said anchor pad FIG. 7 has fanned out raised letters 15*e*, with a depth of about 1/32-inch, used for anchoring its flat bottom surface to the ground or floor. The anchoring occurs from the pressure of an individual's foot or feet stepping and standing on the anchor pad's raised top ring(s) FIG. 4, 15*a*.

Figure 5:
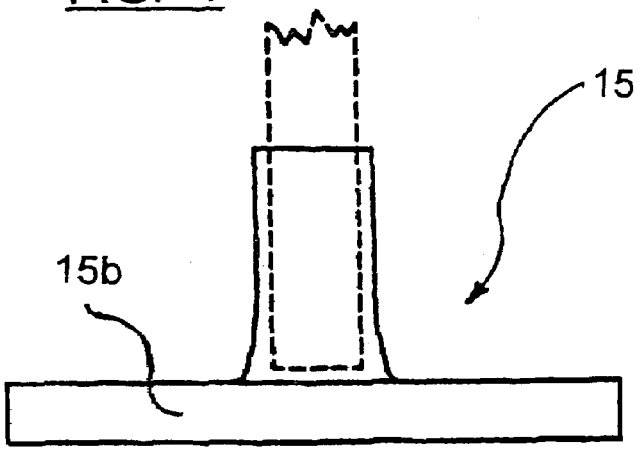
FIG. 5 shows a front view of the anchor pad 15, with a flat perimeter edge 15*b*.
Figure 6:
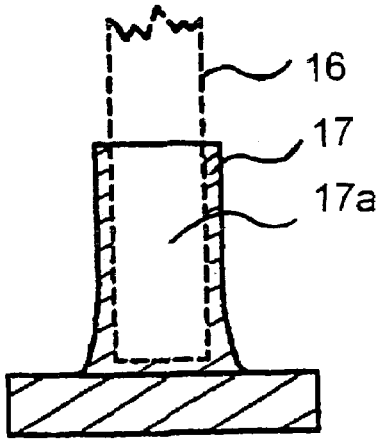
FIG. 6 is a transverse cross sectional view of said anchor pad 15 showing the stanchion's pivotable neck 17 and socket 17*a*.

The flat, vertical, front edge FIG. 5, 15*b* of said anchor pad 15 acts as a straight edge and when being pushed down into the carpet, by the combination of an individual's foot and the stanchion 16, and further aids in gripping and anchoring said anchor pad 15. Said novel (step-on) anchor pad 15 provides a temporary anchor to the ground surface for the personal lift aid 10. Standing on the anchor pad 15 with one or both feet and one's weight, eliminates the need for it to be permanently attached to the floor by means of various fasteners, such as bolts or screws. The (step-on) anchor pad 15 also acts as a pivot point with its molded one piece pivotable neck FIG. 6, 17. It is to be understood that the base end of the stanchion 16 is inserted into the socket opening 17*a* of the pivotable neck 17 so that a friction fitting fit ensues which allows said stanchion 16 to be used at various angles during its operation.

In the preferred embodiment, the anchor pad 15 is secured to the stanchion 16 via friction. However, any securing means chosen within sound engineering judgment, such as a thread and screw type of attachment, screws, nuts and bolts, adhesives, etc., may be used to secure the anchor pad 15 to the stanchion 16.

Due to the stanchion's FIG. 1, 16 height of about 4 feet—a height that is comfortable for most individuals— the personal lift aid 10 more easily assists individuals in descending and ascending stairs. Said stanchion 16 keeps them erect while also extending their base of support, with the anchor pad 15 being positioned on the step in front of them when descending and behind them when ascending for added safety.

Figure 14:
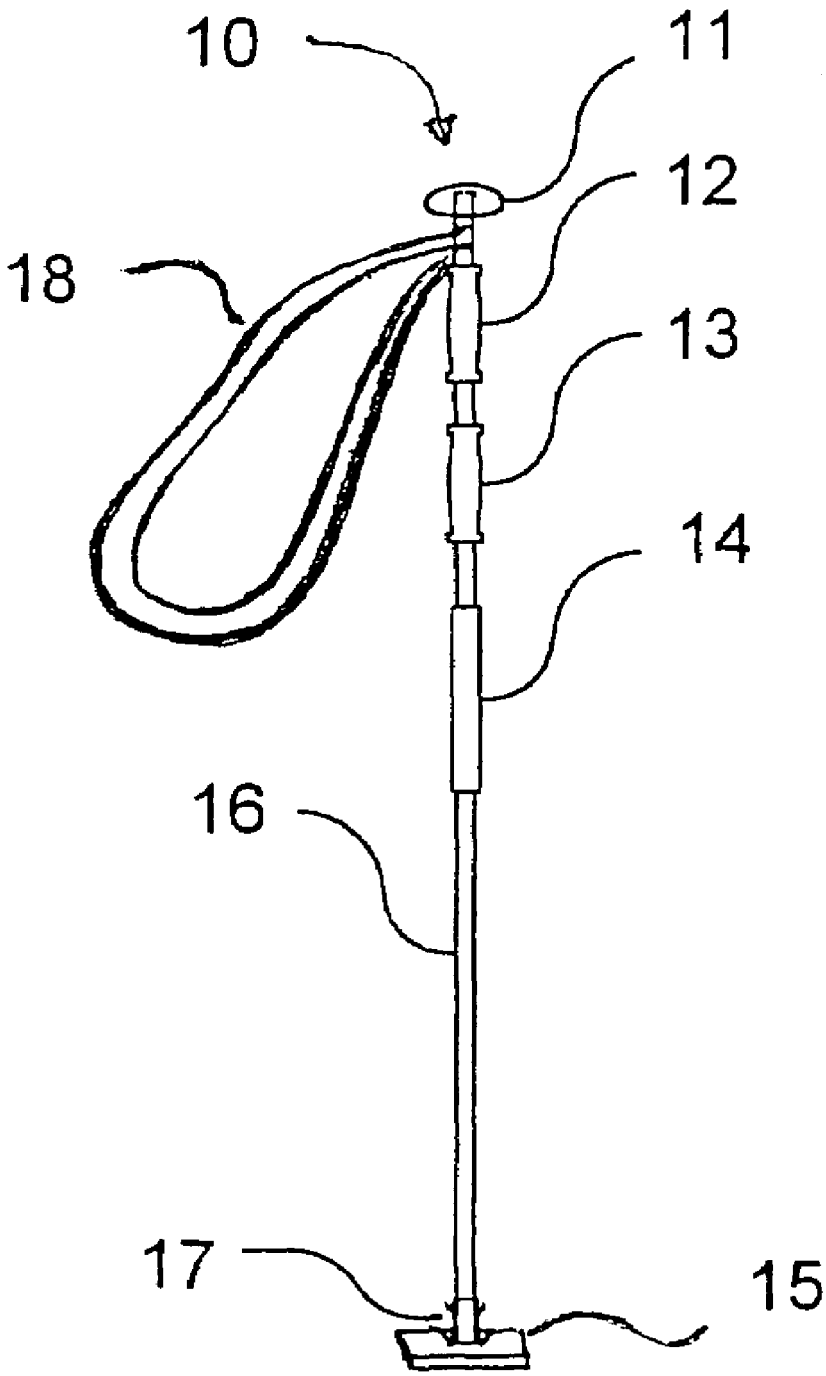
FIG. 14 shows a perspective view of the personal lift aid 10 with a strap 18.

The personal lift aid 10 may optionally include a strap 18, as shown best in FIG. 14. The strap 18 is connected to the stanchion 16 and can be positioned under the arms of a user/patient to provide additional support. Preferably, the strap 18 is removably connected to the upper end of the stanchion. However, the strap can be connected to the stanchion in any manner chosen within sound engineering judgment.

Although the description above contains many specifications and methods of operation for practicing the invention, these should not be construed as limiting the scope of the invention but as merely providing illustrations of some of the presently preferred embodiments of this invention. For example, the stanchion 16 can be made of various types of steel, fiberglass, aluminum, titanium, wood, plastic, metals, etc.; the stanchion 16 can have various shapes such as tapered, square, oval, triangular, etc.; the stanchion 16 can be made of one or more parts with a hollow tube or tubes over each section to make it foldable and/or adjustable which may use various types of locking section devices, such as cams, friction, button locks, etc.; the stanchion can be hollow 16, solid or reinforced, the reinforcement inside the stanchion can be various types such as an x design, parallel lines, hexagon, solid inside, a thicker wall, whether extruded or inserted, etc.; the hand grips 12, 13 and can be of various design and lengths, they can also be horizontally fixed or at any angle to the stanchion, etc.; the hand grips 12, 13 and 14 can be made of any material chosen within sound engineering judgment; the hand grips 12, 13 and 14 can be attached to the stanchion 16 by any means chosen within sound engineering judgment, such as adhesives, screws, nuts and bolts, etc.; the hand grips 12, 13 and 14 can be slidably attached to the stanchion 16 or they can be attached to the stanchion 16 at a fixed position; the anchor pad 15, can be made of any material chosen within sound engineering judgment.; the anchor pad 15 can be made with various inserts, such as metal or plastic, etc.; the anchor pad 15 can have any durometer reading chosen within sound engineering judgment; the anchor pad 15 can be various shapes, such as round, square, oblong, oval, and sizes, such as larger or smaller, etc.; the anchor pad 15 and the pivotable neck 17 do not have to be made from a single molded piece, the anchor pad 15 and the pivotable neck 17 can be to separate and distinct pieces, for example the anchor pad 15 and the pivotable neck 17 can be replaced with a hinge and socket made of various materials and attached by screws, threaded devices, etc.; the palm grip 11 can be made of any material chosen within sound engineering judgment; the palm grip 11 can have any durometer reading chosen within sound engineering judgment; the raised and inverted portions of the bottom of the anchor pad 15 can have any design, shape or size chosen within sound engineering judgment; etc.

With respect to the above description then, it is to be realized that the optimum dimensional relationships for the parts of the invention, to include variations in size, materials, shape, form, function, and manner of operation, assembly and use, are deemed readily apparent and obvious to one skilled in the art. All equivalent relationships to those illustrated in the drawings and described in the specification are intended to be encompassed by the present invention.

Operation

The method of operation is made up of two modes, unassisted and assisted. Said method of operation was developed by the inventor after undergoing surgery to his torso area using himself as a test subject while actually being in pain throughout the development stages of the invention and the techniques herein. These techniques were later reviewed at a nationally rated top hospital by the head of the physical therapy department and her team members for final modification. The techniques are important in that they work in conjunction with the personal lift aid device 10 itself.

The following methods of operation assume you are using the left side of your bed as you are laying on it. When using the right side of the bed, you will need to reverse your body and hand positions.

Figure 8A:
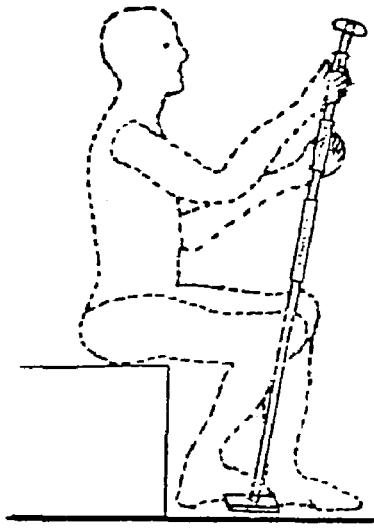
FIGS. 8(*a* and *b*) shows a side view of an individual lifting themselves (unassisted) to a standing position. (a) starting position; (b) rising position FIGS. 9(*a* and *b*) shows front view of a supine individual lifting themselves (unassisted) in bed to a sifting position. (a) starting position; (b) rising position FIGS. 10(*a* and *b*) shows a side view of an patient/individual being lifted (assisted) from a bed or chair to a standing position by a caregiver. (a) starting position; (b) rising position FIGS. 11(*a* and *b*) shows a side view of a supine patient/individual being lifted (assisted) in bed to a sitting position by a caregiver. (a) starting position; (b) rising position FIGS. 12(*a* and *b*) shows a side view of an individual in the process of (a) descending and (b) ascending stairs unassisted, with one hand on the personal lift aid 10 and the other hand on a handrail, if one is available.
Figure 8B:
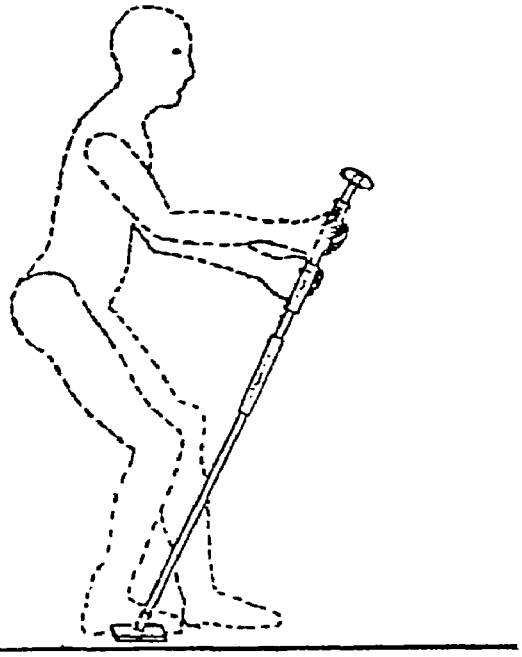
Figure 13:
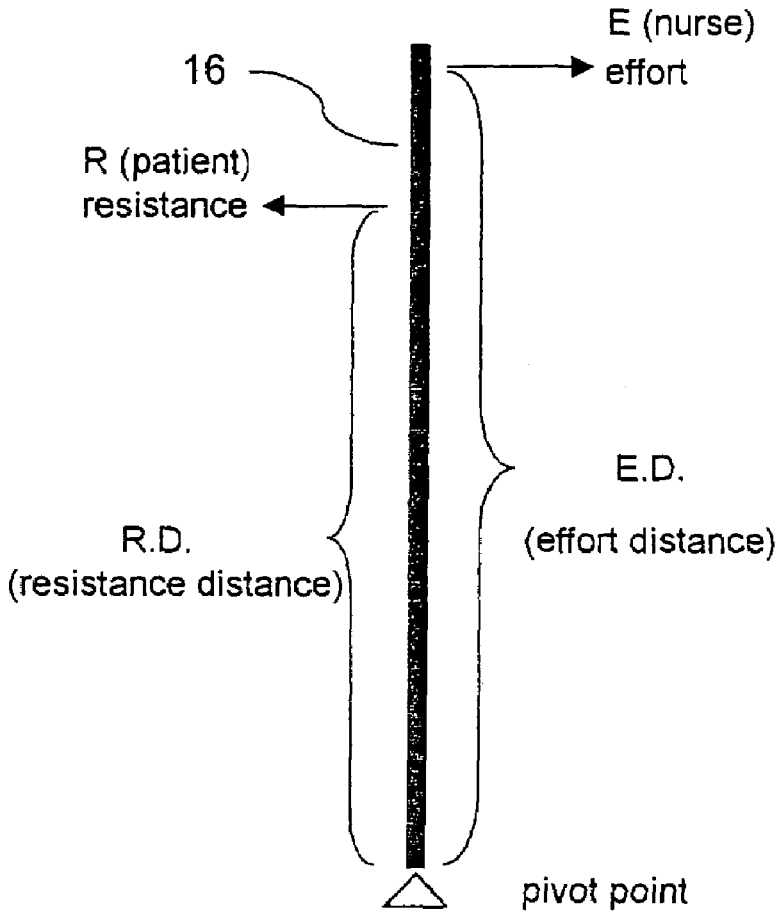
FIG. 13 shows mechanical advantage using leverage.

The methods of operation employ the mechanical advantage of leverage FIG. 13 while utilizing a lever (stanchion) 16 to move the center of gravity over a base (pivot point). Refer to the drawings and, in particular, to FIG. 1 for the Reference Numerals noted in the following unassisted and assisted methods of operation. The unassisted methods of operation are as follows:

To lift yourself to a standing position unassisted FIGS. 8(*a* and *b*) when sitting on the edge of a bed or chair, grasp the personal lift aid 10 with your right hand on grip 12 and your left hand on grip 13. Located at the top of the personal lift aid 10, these grips 12, 13 and 14 are adjustable by pushing with your fingers at the top or bottom of each grip 12, 13 and 14 to slide them up or down so that they can adjust to your personal height and individual comfort zone. When you do grasp the grips 12, 13 and 14, you will notice that they will not move.

Place the anchor pad 15 about 6 inches in front of the bed or chair. Place the ball of one foot on said anchor pad's top ring FIG. 4, 15*a* to temporarily anchor it to the ground and your other foot on the floor where comfortable. Preferably, the palm grip 11 at the top of the personal lift aid 10 is angled away from you approximately 20-degrees.

Position and maintain your elbows slightly bent and at your sides and use your arms while lifting. Now, using the strength of your legs and arms with the help of the personal lift aid 10, pull yourself up and forward, all in one motion. Straighten your legs and back as you rise.

To lower yourself to a sitting position, reverse the same technique as described above, grasping hand grips 12 and 13 and letting yourself down slowly.

Figure 9A:
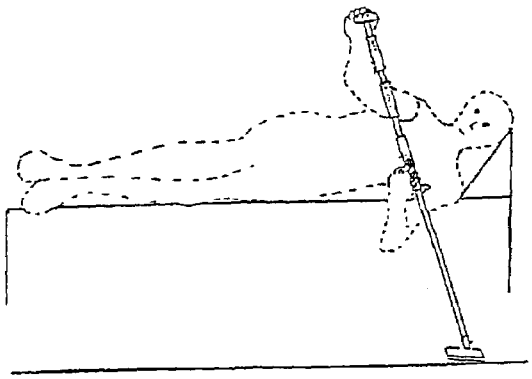
Figure 9B:
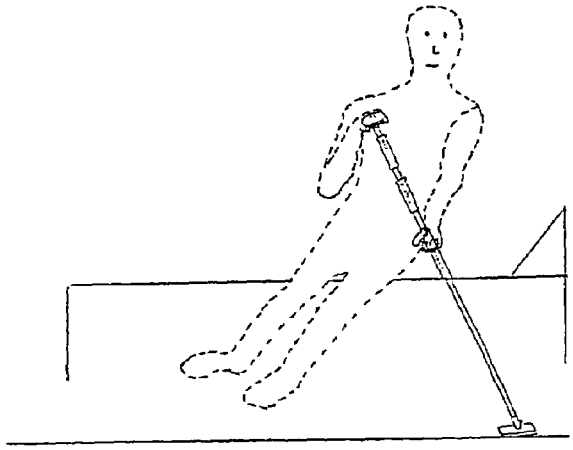

To lift yourself to a sitting position in bed unassisted, FIGS. 9(*a* and *b*), first roll onto your left side to the edge of the bed. Place the anchor pad 15 on the floor, back toward the headboard. Preferably, the palm grip 11 located at the top of the personal lift aid 10 will be angled away from, toward your feet at about a 30–45 degree angle.

Firmly hold hand grip 14 with your left hand while grasping palm grip 11 with your right hand.

Now pull yourself up, using a pushing-out and away from you motion with your left hand, while pulling down and in toward yourself with your right hand.

To lower yourself to a lying-down position while sitting up in bed, place the personal lift aid 10 at a 45-degree angle. Let yourself down slowly while firmly holding hand grips 12 and 13.

The assisted methods of operation are as follows:

Depending on the individual, the caregiver will know and approve when the person is ready to use the personal lift aid 10, as some individuals may feel faint or too weak to move by themselves. Each individual must be personally evaluated as to the support the need. If this is the first time the individual has tried to stand up, a second caregiver will be required to support the individual before using the personal lift aid 10.

Figure 10A:
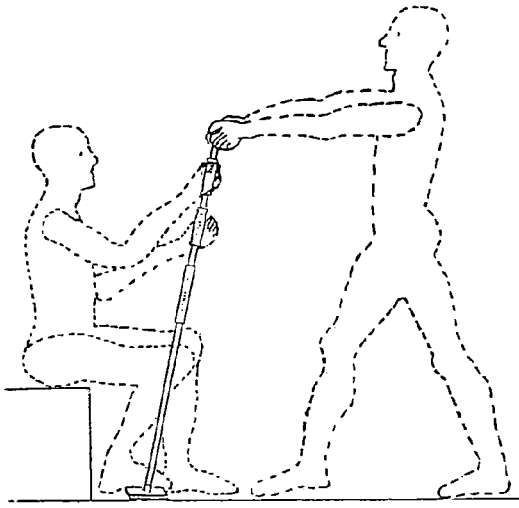
Figure 10B:
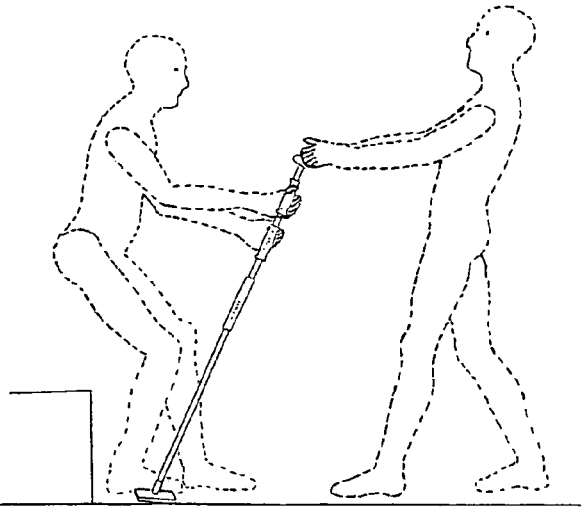

To lift an individual to a standing position assisted, FIG. 10(*a* and *b*) have the individual sit on the edge of the bed or chair, then place the anchor pad 15 about 6 inches in front of the bed or chair. Have the individual place one or both feet on the top of the anchor pad 15. The individual grasps the personal lift aid 10 with the right hand on grip 12 and left hand on grip 13. Preferably, the individual will keep their arms bent and at their sides while being lifted. Make sure that the palm grip 11 located at the top of the personal lift aid 10 is angled in front of the individual toward the caregiver approximately 20-degrees.

Next, the caregiver faces the individual and grasps palm grip 11 (one hand on top of the other) with arms straight out and elbows locked. It is to be understood that the caregiver could use only one hand, as well as using bent arms. The caregiver facing the individual places one foot about 18 inches from the anchor pad 15 and the other foot as far back as is comfortable.

Now, all the caregiver has to do is lean back slowly for leverage, allowing their weight to do most of the work while the individual assists by leaning forward (slightly) and straightening their back as they rise up.

Figure 11A:
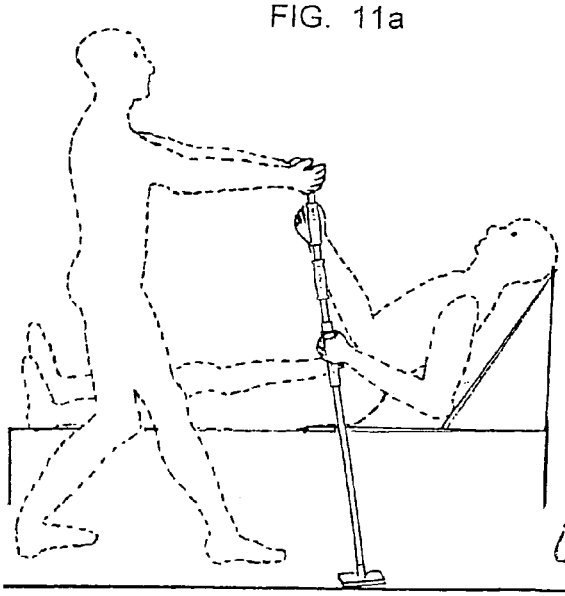
Figure 11B:
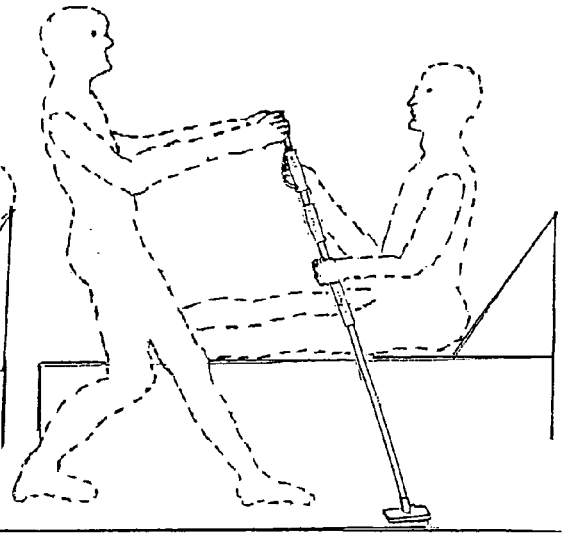

To sit a person up in bed assisted, FIGS. 11(*a* and *b*) the individual should be lying flat on their back. The personal lift aid 10 is placed on the floor just to the top of the individual's hips and next to the bed with the palm grip 11 pointing toward the individual's feet at about a 20-degree angle. The individual should grasp hand grip 12 or 13 and hand grip 14 at this time.

Next, the caregiver facing the patient places their right foot behind the anchor pad about 12 inches and close to the bed. The other foot should be placed about 18 inches further back Lastly, the caregiver places two hands on palm grip 11 with their arms straight out and elbows locked, and pulls the personal lift aid 10 parallel along side the mattress toward the foot of the bed while sitting the individual up during the process. The individual should only use their arms to assist the caregiver.

To lower the individual onto the bed from a standing or sitting position, use the same techniques used to stand or sit the individual up, but this time start by leaning back and letting the personal aid lift 10 down slowly, adjusting for the weight of the individual.

Figure 12A:
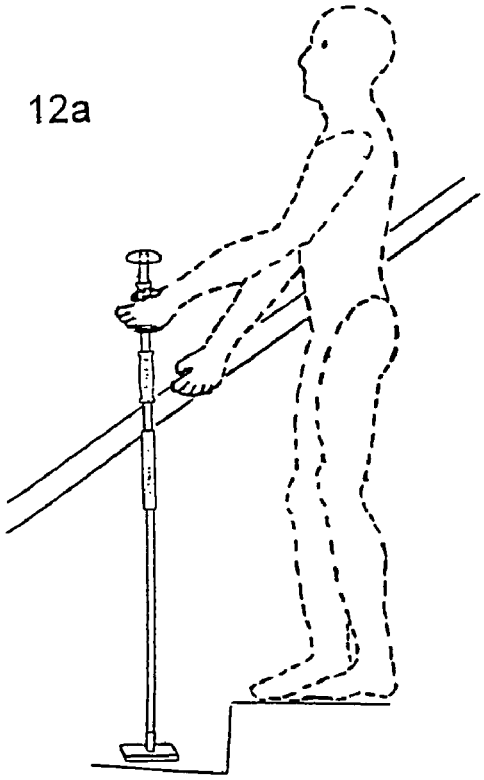

The instructions for descending and ascending stairs, FIGS. 12(*a* and *b*) are as follows:

To use the personal lift aid 10 when descending stairs FIG. 12*a*, place one hand on the handrail. Firmly grasp hand grip 12 with the other hand.

Place the anchor pad 15 onto the next step down from the one you are standing on. Now you are ready to descend to that step. With both feet on that step, place the anchor pad 15 down to the next step and repeat.

Figure 12B:
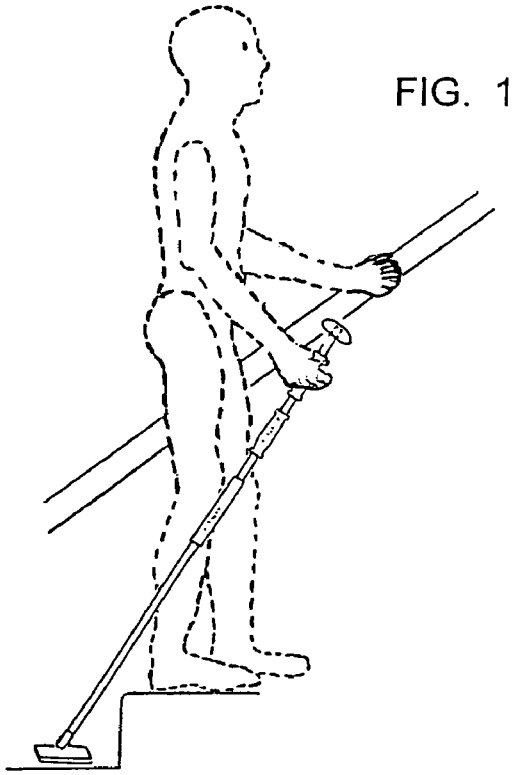

To use the personal lift aid 10 while ascending stairs FIG. 12*b*, place one hand on the handrail. Firmly grasp hand grip 12 with the other hand. Preferably, the anchor pad 15 will be placed sideways on the step you are currently on.

Now, step up to the next step with one foot then the other. When both feet are on that step, bring up and place the anchor pad 15 on that step. You are now ready to move up to the next step.

As you ascend the stairs, always start by placing the anchor pad 15 on the step next to your feet. This will help protect you from falling backwards. Preferably, both feet will be together on the same step before proceeding to ascend to the next step.

By placing the anchor pad on the foregoing steps your are increasing your base of support when ascending and descending stairs thereby increasing your safety. Caution, take only one step at a time when ascending or descending stairs.

The foregoing describes the preferred methods of using the personal lift aid 10. However, the methods are only the preferred embodiment and should not be construed to limit the invention in any way. Any method of using the personal lift aid 10 that is chosen with sound judgment is covered by this invention. For example, the patient or the caregiver can grasp the stanchion 16 directly if the stanchion does not have hand grips; the patient or the caregiver can place their hands on one hand grip, multiple hand grips or the palm grip; the caregiver can exert a force on the stanchion 16 to lift the user either by leaning back or by pulling on the stanchion 16; the user's or the caregiver's arms can be bent or straight when using the personal lift aid 10; the caregiver can step on the anchor pad 15 when using the personal lift aid 10 to lift the user from a supine position to a sitting position; the user can merely grip the stanchion 16 for support or he/she can exert a force on the stanchion 16 to aid in his/her movement from a first position, such as a sifting position or a supine position, to a second position, such as a standing position or a sifting position, by the caregiver; the personal lift aid 10 can be in an angled or vertical position when used; etc.

Notice that the foregoing methods of operation stated are protected by the mark Copyright© 2001 by gimme a Lift™, All rights reserved.

A personal lift aid 10 is described above. Various details of the invention may be changed without departing from its scope. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of moving a person from a first position to a second position, the method comprising the steps of:

providing a lifting device, the lifting device comprised of:

an elongated member of rigid material having an upper and a lower end;

an anchor pad; the lower end of said elongated member being pivotably attached to said anchor pad; and, placing said anchor pad on a surface near said person, said person being in said first position;

having said person grasp said elongated member with at least a first hand;

having an associated caregiver grasp said elongated member with at least a first hand; and, having said caregiver exert a force on said elongated member in a direction substantially toward said caregiver to lift said person from said first position to said second position.

2. The method of claim 1, further including the steps of:

providing a palm grip operatively attached to said upper end of said elongated member; and, wherein the step of having said caregiver grasp said elongated member with said at least first hand further includes the step of having said caregiver grasp said palm grip with said at least first hand.

3. The method of claim 1, further including the steps of:

providing at least a first hand grip operatively attached to said elongated member; and, wherein the step of having said person grasp said elongated member with said at least first hand further includes the step of having said person grasp said at least first hand grip with said at least first hand.

4. The method of claim 1, further including the step of having said person exert a substantially downward force on said elongated member

5. The method of claim 1, further including the step of having said person place at least a first foot on said anchor pad.

6. The method of claim 1, further including the step of having said caregiver place at least a first foot on said anchor pad.

7. The method of claim 1, further including the step of angling said elongated member substantially toward said caregiver.

8. The method of claim 7, wherein said person is substantially horizontal when in said first position and said user is substantially seated when in said second position.

9. The method of claim 7, wherein said person is substantially seated when in said first position and said person is substantially standing when in said second position.

* * * * *